United States Patent [19]

Laido

[11] Patent Number: 4,802,619

[45] Date of Patent: Feb. 7, 1989

[54] STORAGE AND TRANSPORT CONTAINERS FOR HEAVY AND/OR FRAGILE OBJECTS

[76] Inventor: Michael Laido, 575 N. Midland Ave., Saddle Brook, N.J. 07662

[21] Appl. No.: 185,428

[22] Filed: Apr. 25, 1988

Related U.S. Application Data

[63] Continuation of Ser. No. 935,776, Nov. 28, 1986, abandoned.

[51] Int. Cl.[4] ..... B65D 5/20; B65D 5/68

[52] U.S. Cl. ..... 229/125.19; 206/611; 229/125.32; 229/167

[58] Field of Search ..... 229/167, 919, DIG. 11, 229/23 BT, 125.19, 125.32; 206/424, 454, 455, 456, 54, 586, 611, 628

[56] References Cited

U.S. PATENT DOCUMENTS

| | | | |
|---|---|---|---|
| 2,272,078 | 2/1942 | Zalkind | 229/43 |
| 2,301,575 | 11/1942 | Otten | 206/620 |
| 3,049,283 | 8/1962 | Buttery et al. | 206/620 |
| 3,185,662 | 5/1965 | Feo | 229/167 |
| 3,371,843 | 3/1968 | Hainey | 229/167 |
| 3,499,597 | 3/1970 | Katzman | 229/167 |
| 3,603,500 | 9/1971 | Dutcher | 229/167 |
| 3,926,362 | 12/1975 | Beck et al. | 229/43 |

FOREIGN PATENT DOCUMENTS

| | | | |
|---|---|---|---|
| 1116896 | 5/1956 | France | 229/167 |
| 1477609 | 3/1967 | France | 229/167 |
| 261194 | 11/1962 | Netherlands | 206/628 |
| 155529 | 12/1920 | United Kingdom | 229/43 |
| 799792 | 8/1958 | United Kingdom | 229/DIG. 11 |
| 884054 | 12/1961 | United Kingdom | 229/167 |

*Primary Examiner*—Stephen Marcus
*Assistant Examiner*—Gary E. Elkins
*Attorney, Agent, or Firm*—Myron Amer

[57] ABSTRACT

A box tray has rectangular bottom wall and opposing pairs of perpendicular side and end walls. Each of the side and end walls are formed from integral extensions of the corresponding edges of said bottom wall foldable into a tubular rectilinear cross-section defined in sequence by outer panel, a top panel, an inner panel, a bottom panel and an interior panel. The interior panel when folded lies contiguous to the inner surface of the outer wall panel and is fixedly secured to it. Flaps integrally extend from the lateral ends of the outer panel of one of the paired sides and end walls so as to be fixedly inserted between the contiguous outer and interior wall panels of the other pair of side or end walls to thereby maintain the side and end walls perpendicular and at right angles to each other.

3 Claims, 3 Drawing Sheets

STORAGE AND TRANSPORT CONTAINERS FOR HEAVY AND/OR FRAGILE OBJECTS

This is a continuation of application Ser. No. 935,776, filed Nov. 28, 1986, now abandoned.

BACKGROUND OF THE INVENTION

The present invention relates to the construction of shipping and storage containers, and particularly to a tubular wall box tray for forming storage and transport containers for heavy and/or fragile objects.

A particularly vexing problem has arisen in the shipping and storage of x-ray film, comprising large sheets of gelatin like material, coated with silver or other precious metals. These sheets are of such size and weight that even enclosing them in individual envelopes does not afford the necessary protection against distortion or adhesion of the sheets to the envelope or each other when boxed and stacked for storage or shipment. The weight of the film is so great that only a few sheets can be boxed in a single container and only a few containers can be stacked one upon the other before the containers begin to warp and the total weight destroys the containers lowermost in the stack. The warping of the containers further causes the sheets to compress together resulting in the sheets sticking and pasting together thus destroying their usefulness.

While this problem is particularly troublesome in connection with x-ray film there are no doubt many other fields in which the problem arises particularly with regard to the storage and shipment of fragile articles such as chinaware, glassware or plastic industrial components. Thus, while the present invention was made with particular regard to the shipment and transport of x-ray film, it will be clearly understood from the following that it does in fact have wide applications.

It is therefore a primary object of the present invention to provide a container which would permit the transport of heavy sheet material or fragile objects and which is so strong as not to be distorted, crushed or otherwise destroyed as a result of great weight being placed thereon.

It is an object of the present invention to provide a tubular wall box tray component for forming transport containers wherein the walls are of such strength and rigidity so as to enable a great number of such trays, and/or covered containers formed with such trays to be stacked one upon the other wherein the weight of the contents are distributed to the peripheral edges thereby relieving the interior bottom wall of any weight stress and wherein the tubular walls do not sag laterally.

A general object of the present invention is to provide a tubular wall box tray from a single blank, which can be easily shipped in flat, and which can be erected, for use, by merely folding over the side edges into the tubular wall, structure and by combining such trays into complete containers.

Other objects of the present invention, together with numerous advantages will in part be obvious from the following disclosure and will in part appear from detailed description therein.

SUMMARY OF THE INVENTION

According to the present invention a storage and shipping container is constructed from at least one box tray comprising a rectangular bottom wall and opposing pairs of perpendicularly erected side and end walls.

Each of the side and end walls are formed from extensions integral with the corresponding edges of the bottom wall and are foldable into a tubular rectilinear cross-section defined in sequence by an outer panel, a top panel, and an inner panel, a bottom panel, and an interior panel. The tubular wall is erected by folding the extensions so that the outer and inner panel and the top and bottom panels lie parallel to each other respectively, and the interior panel lies contiguous to the inner surface of the outer wall panel and is fixedly secured to either or both the outer wall and the interior wall. The outer panels of either pair of side end extensions are provided with laterally extending flaps which are fixedly inserted between the contiguous outer and interior wall panels of the other, i.e., adjacent side or end extensions. As a result end flaps are held securely in place thus maintaining all of the walls perpendicular to the flat bottom wall of the tray and at right angles to each other.

It is preferred that the inner, bottom and interior panels of one of the pair of side and end extensions have a length which is shorter than the length of the corresponding panels on the other pair of side or end extensions by an amount equal to the combined cross-sectional width of the walls erected from the one or first pair of side and end extensions so that when all the extensions are folded and erected into their respective walls, the extensions provided with the shorter panels which form walls, abut at right angles and lie between the adjacent walls.

A complete container may be made of two such trays wherein the trays have respective inner and outer dimensions which mate with each other so that one may be placed as a cover over the other. On the other hand, it may be preferred to provide a simple flat covering wall over one of the trays thereby to merely enclose the tray, simplifying and providing a less costly container. In any event, at least one tray of a complete container has rectilinear cross-sectional tubular walls extending about the entire periphery of the tray which provides a peripheral edge which is strong and rigid in both the vertical and horizontal directions. Consequently, numerous containers or trays of this type can be stacked one upon the other, and virtually all of the weight of the contents of each container will be transferred to the outer peripheral edges and the weight is directed downwardly through the successively stacked rectilinearly tubular walls.

Full details of the present invention are described in the following illustration of the preferred embodiments of the present invention and in the accompanying drawings.

DESCRIPTION OF THE INVENTION

Figure 1:
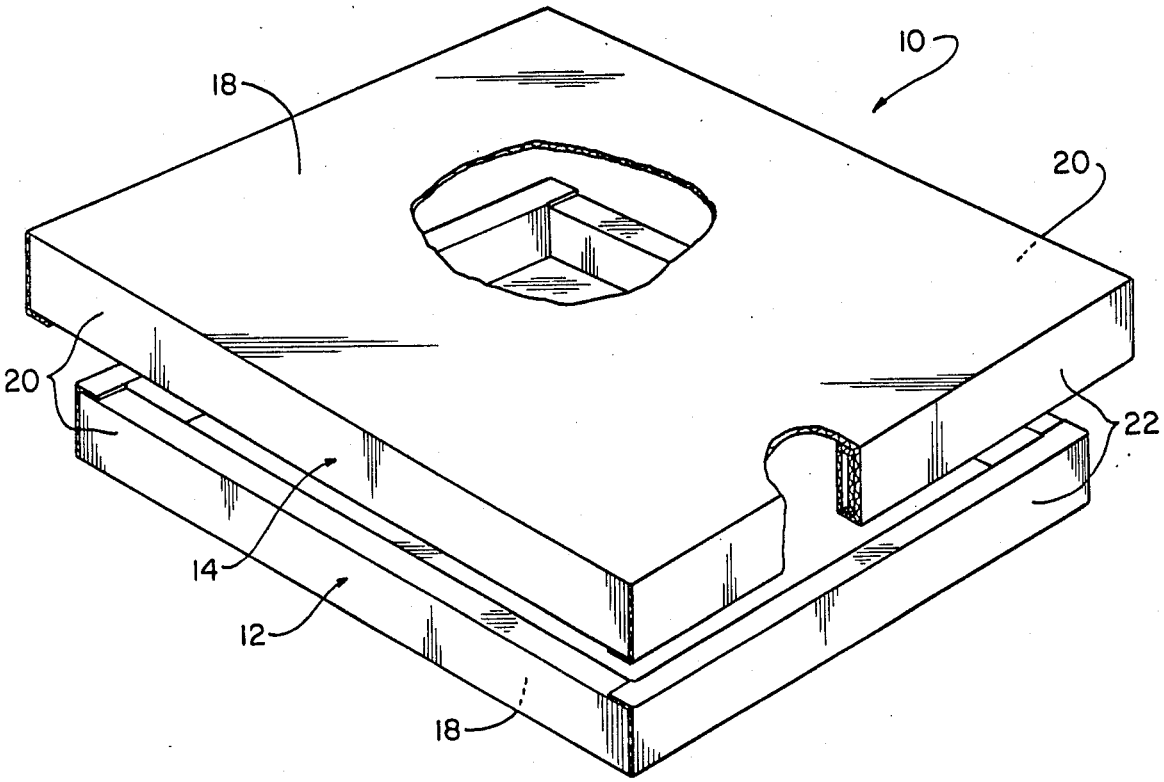
FIG. 1 is a perspective view of a bottom and cover tray, each embodying the present invention, forming a complete storage and shipping container, the cover is partly broken away and spaced apart from the bottom to show the constuction thereof.
Figure 5:
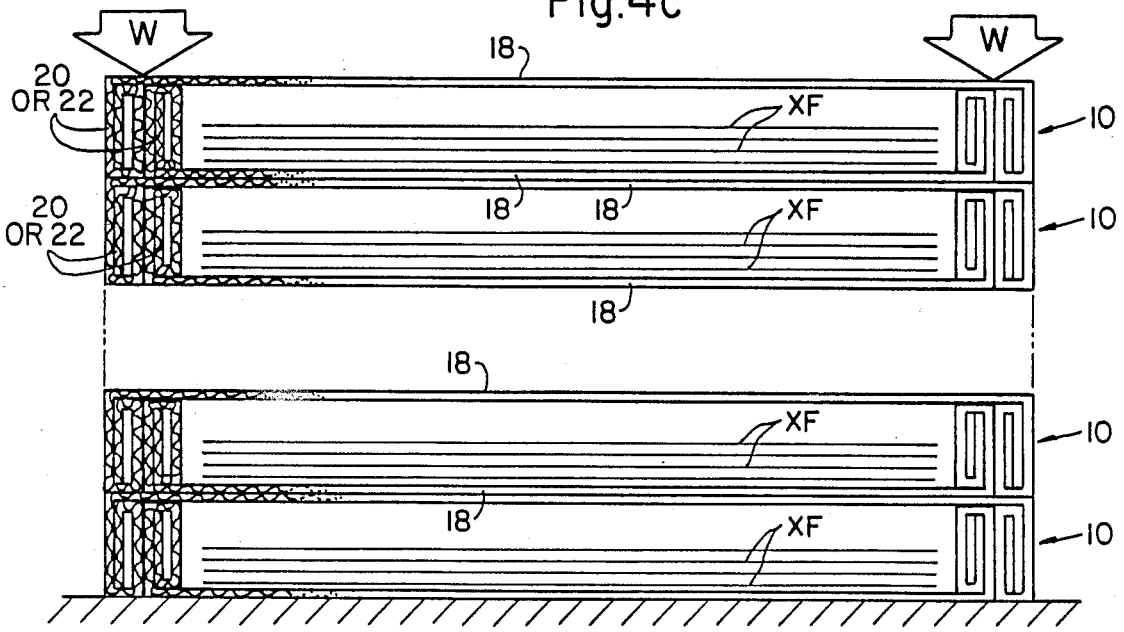
FIG. 5 is a cross-sectional view of the plurality of containers shown in FIG. 1, one stacked upon each other.

FIGS. 1 and 5 show a fully erected box generally depicted by the numeral 10, formed in accord with the present invention and having a bottom tray 12 and a top cover tray 14, the later of which is slightly larger in all dimensions so as to fit slidably, but preferably closely over the bottom tray 12. Of course, the container components may be reversed so that the bottom tray 12 is larger than the cover tray 14 if so desired. Other than in their dimensions, the top and bottom trays 12 and 14 are identical in construction as well as in erection, each preferably being formed from a single blank 16 (FIGS. 2 and 3) of corrugated paste board although the other sheet material such as plastic which may be capable of being folded and maintainable in folded and erected condition with great strength, may also be used. Each tray 12, and 14 when erected comprises a rectangular bottom wall 18 and integral side and end walls 20 and 22 respectively, each being formed as identical hollow tubular rectilinear channel sections.

Figure 2:
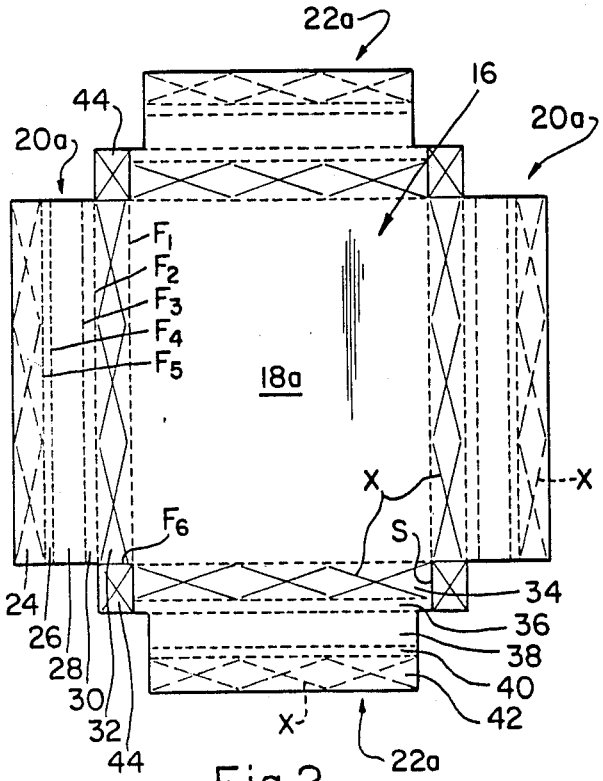
FIG. 2 is a plan view of the blank from which the cover tray shown in FIG. 1 is formed.
Figure 3:
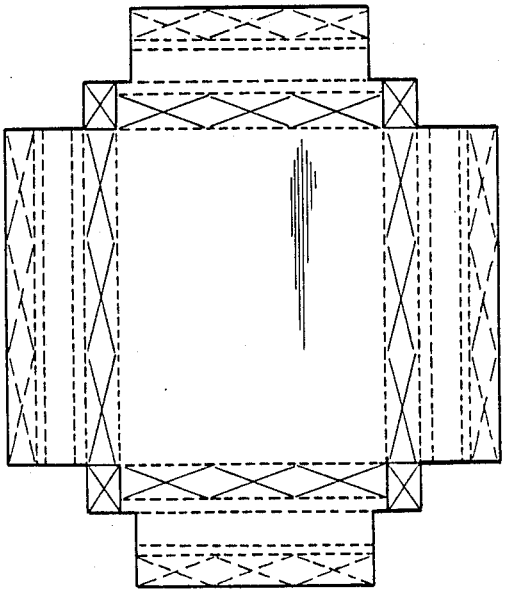
FIG. 3 is a view similar to that of FIG. 2 showing the blank from which the bottom tray of FIG. 1 is formed.

As seen in FIGS. 2 and 3, the blanks 16 from which the tray 12 and 14 are formed are identical except for their overall dimensions and thus since the same reference numbers are used to denote the structural features of each. These reference numbers have been omitted in FIG. 3 as being unnecessary. In the figures fold lines are designated by the interrupted lines F while cut lines are illustrated by the solid lines S. The large X used in the figures illustrates adhesive on the facing surface, the interrupted X lines illustrate the adhesive on the reverse surface. The double arrows A illustrate the direction of the corrugation of the board forming the blank, and are shown for illustration only, as extending transverse to the length of the blank and therefore perpendicularly to the side edges.

Turning to the detail of FIGS. 2 and 3, each blank 16 is divided to define a base panel 18*a* eventually forming the bottom wall 18 of the finished tray (12,14) and integral wall forming extensions 20*a* and 22*a* from which the side and end walls 20, 22 of the tray 12, 14 are respectively erected. Each of the side walls forming extensions 20*a* are divided, in sequence, by the fold lines F1 through F5 into an outer panel 24, a top panel 26, inner panel 28, a bottom panel 30, and an interior panel 32 which are of equal length to the corresponding edge of the base panel 18*a* and wherein the outer, inner, and interior panels 24, 28, and 32, and the top and bottom panels 26 and 30 are respectively substantially equal to each other. Similarly, the end wall extensions 22*a* are divided into an outer panel 34, a top panel 36, an inner panel 38, a bottom panel 40 and an interior panel 42. However, the inner panel 38, the bottom panel 40 and the interior panel 42 in these extensions 22*a* are shortened in length relative to the corresponding edge of the base panel 18*a* from which they extend by an amount substantially equal to the width w (FIGS. 3 and 4) of the top and bottom panels of the adjacent side wall extensions 20*a*. The foregoing dimensions are essential to permit the end wall extensions 22*a* to be folded into the desired hollow rectilinear cross-section of the end walls 22 and to be erected between the similarly erected side walls 20, so that all the walls are perpendicular to the bottom wall 18 as well as at right angles to each other.

Lastly, the lateral edges of the interior panels 24 in each of the side extensions 20*a* are provided with a flap 44 which folds on fold line F6 in the direction to overlie the panel, to which it is attached. The surfaces of the flaps 44 are also provided with adhesive. The upper surfaces of the outer panels 24 and 42, and the undersurface of each of the interior panels 32 and 34, in each of the extensions 20*a* and 22*a* are provided with an adhesive x, preferably a contact adhesive which fixes immediately upon mutual contact. The blank 16 is thus completely formed and capable to be erected into either the bottom or cover tray.

Figure 4A:
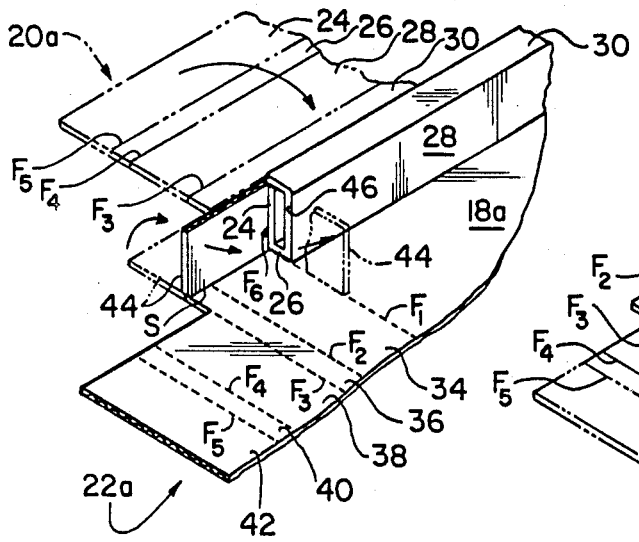
FIGS. 4*a* –4*b* are partial sectional views showing the manner in which the trays seen in FIG. 1 are erected.
Figure 4B:
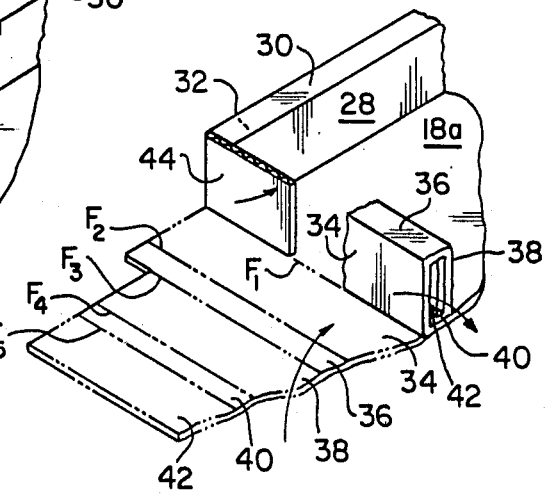
Figure 4C:
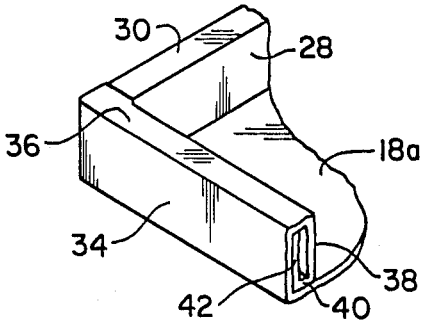

Erection of each of the extensions 20*a* and 22*a* follows an almost identical process as seen in FIGS. 4*a* through 4*c* although first the side extensions 20*a* are folded. Folding follows more or less sequentially, initially from the extreme outer end (i.e., the interior panel 32) and thence along each of the folded lines F5–F1, until the panels are placed 90 degrees to each other (see FIG. 4*a*). This act of folding is akin to rolling the extension 20*a* into its rectilinear tubular form until the interior panel 32, is placed contiguous with and has its adhesive surface abutting against the adhesive surface of the outer panel 24. At this stage, the outer panel 24 and the interior panel 32 contact each other with some degree of force so that the adhesive is caused to firmly fix the panels one to the other, thereby forming a rigid tube of rectilinear cross-section. Upon completing the folding of the extensions 20*a*, the flaps 44 are folded inwardly against the frontal ends 46 of the erected side walls 26 in line with the fold line F1 between the base panel 18*a* and the end wall extensions 22*a* as seen in FIG. 4*b*.

Thereafter, the shorter end wall extensions 22*a* are folded and rolled in the same manner as the side extensions 20*a* except that the flaps 44 are lodged between the adhesive surface of the outer panel 34 and the adhesive surface of the interior panel 42, during the last stage of folding. Because of the shorter length of the appropriate panels, each of the end extensions 22*a* forms a rigid tubular end wall 22 which fits between the erected side walls 20 at a square or right angle abuttment as seen in FIG. 4*c*. Thus the end walls 22 stand at right angles to the side walls 20 as well as at right angles to the bottom wall 18. In this condition, the top panels 40 of the end walls 22 overlie, at the corners, the top panels 26 of the side walls 20.

The flaps 44 are held securely between the outer and interior panels 34 and 42, respectively, and because they are also provided with adhesive they are fixedly positioned in this condition and cannot be pulled out. In this manner, the right angle abuttment between the side and end walls 20 and 22 is constantly maintained, making all the peripheral end faces continuous and insuring that the walls 20 and 22 remain erect and vertical with respect t the bottom wall 18 without being otherwise adhered to the bottom wall itself. However, adhesive such as the contact cement may be placed between the bottom panels 30, 36 and the bottom wall 18 if further assurance is desired. Of course, other means for securing the interior and outer walls as well as the flaps, such as rivets, staples or the like can be used instead of the adhesive.

A plurality of trays 12 and 14 forming a complete covered container, each containing a plurality of sheets, such as X-ray film or other fragile articles stacked one upon the other, are shown in FIG. 5. The total weight or force is distributed evenly toward the periphery, where the rectilinear tubular walls 20, 22 support the containers one above the other. It will be observed that each of the rectilinear walls has three vertical panels (i.e., the outer, inner and interior panels) of coextensive height, arranged parallel to each other and perpendicular to the bottom wall, while also having a pair of horizontal top and bottom walls, which are similarly coextensive to each other and parallel to the bottom wall. In this manner, great strength and rigidity is provided both in the vertical, as well as in the lateral or transverse direction. The trays will remain erect and will not be distorted and even under great internal force or weight created by the contents of each container, the peripheral walls will not sag laterally inward, great tension being provided to the bottom wall both in the longitudinal and transverse directions. As a result an upper box will not cause compression of the contents in a lower box no matter how high or heavy the stack is made.

Figure 6:
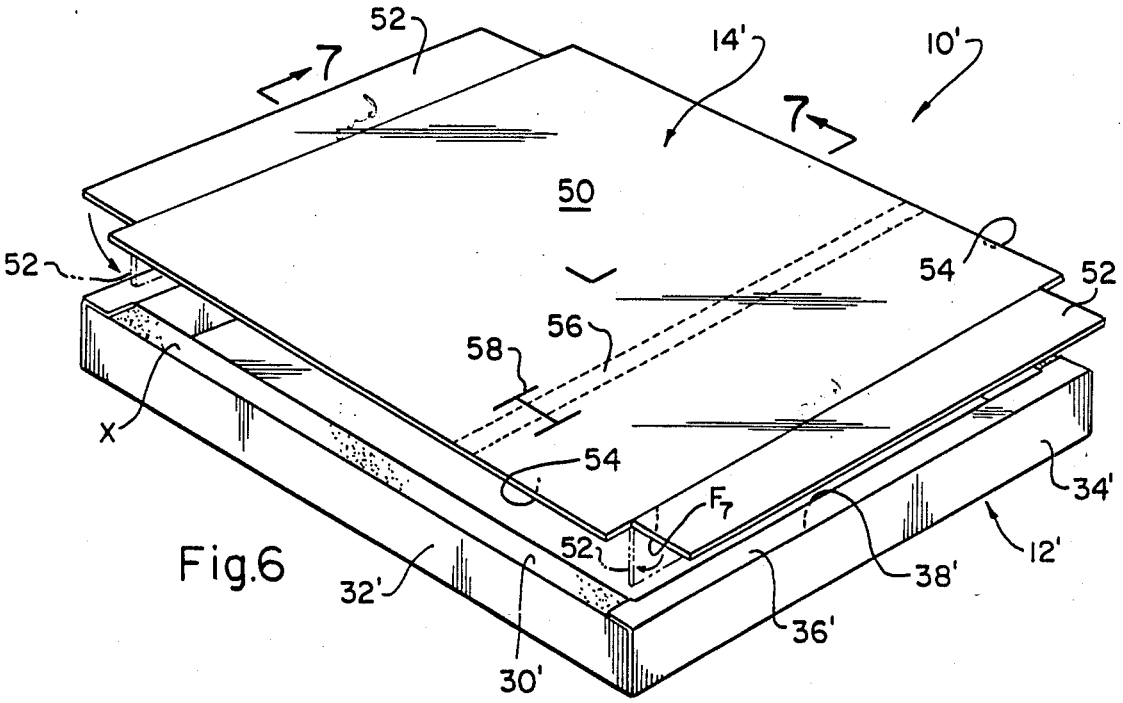
FIG. 6 is a view similar to that of FIG. 1 showing a modified form of cover for the container.
Figure 7:
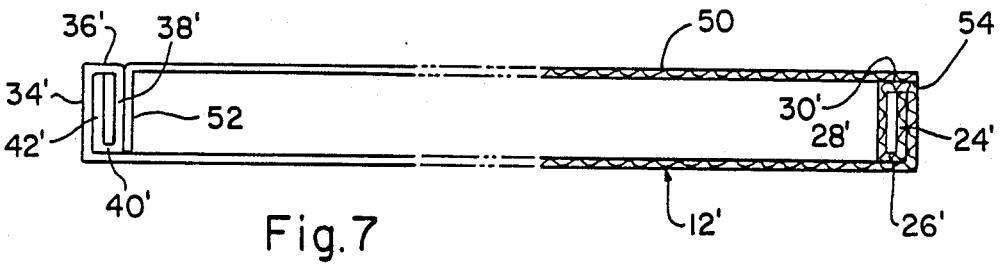
FIG. 7 is a compound sectional view through the container shown in FIG. 6.
Figure 8:
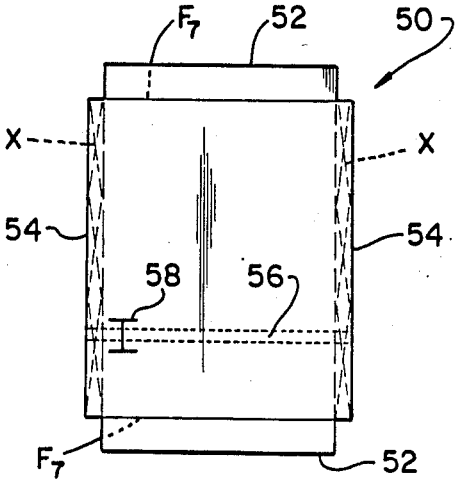
FIG. 8 is a plan view of the cover shown in FIG. 6 prior to its installation in place.

In the embodiment of FIG. 6 through 8, a container generally depicted by the numeral 10' is shown in which a bottom tray 12' identical with that earlier described is provided. In this embodiment, however, a cover 14' of a different sort is provided. This cover is made from a single rectilinear sheet 50 (FIG. 8) having a transverse width substantially equal to that of the outside width of the bottom tray 12' from side wall to side wall, a length equal to the interior length of the bottom tray 12' from end wall to end wall, plus an extension 52 at each end substantially equal to the depth d of the walls. These extensions 52 are foldable along a fold line F7, in the direction of the arrows so that they depend perpendicularly toward the bottom wall 18' of the bottom tray 12'. The cover 14' can thus be placed over the bottom tray 12' so that the marginal side edges 54 (defined by the dot-dash lines) of the cover 14' fit over the top panels 26' of the bottom tray while the downwardly folded extensions 52 are contained within the tray.

Each of the extensions 52 may be provided with adhesive so that as they are placed into the tray, they will adhere firmly to the surface of the inner panels 38' of the end walls 22'. The top walls 26' and 36' about the periphery of the tray and the undersides of the marginal side edges 54 of the cover 14' may be similarly provided with adhesive so that as seen in FIG. 7 the cover 14' and the bottom tray 12' may be firmly and solidly sealed about their entire periphery. Preferably the cover 14' for the container 10' shown in FIG. 6 is provided with a tear tape 56 and an H-slit 58, which permits the cover 14' to be torn when access to the contents are required.

While the embodiment of FIGS. 6–8 does not include both a cover and a bottom tray of equal construction, it will be apparent that the bottom tray 12' is of sufficient strength that the advantages enumerated earlier are met here as well, even though the cover 14' is a mere sheet.

Various modifications and changes have been described herein, others will be apparent to those skilled in the art. Accordingly, it is intended that the present disclosure be taken as illustrative only and not limiting of the invention.

What is claimed is:

1. A container comprising a box tray component including a rectangular bottom wall having integral extentions at each side and end edge, each of said extentions being provided with fold lines defining in sequence an outer panel, a top panel, an inner panel, a bottom panel and an interior panel, and a flap integrally extending from each lateral end of each interior panel of the pair of side extentions, said extentions being foldable into opposing pairs of rectangular cross-sectioned upstanding tubular walls with each of said extending flaps of said interior panels lying contiguous to an inner surface of an outer wall panel of a side extention, said cross-sectioned tubular walls formed by said side and end extentions being at right angles to each other.

2. The container of claim 1 wherein the inner, top and outer panels of said extentions are shorter than the length of the interior and bottom panels of said end extentions by an amount equal to twice the width of said bottom panels of said side extentions so that when said side and end extentions are folded into said tubular wall configurations the interior and bottom panels of said end extentions while the inner, top and outer panels of said end extentions lie between and against the inner panels of said side extentions.

3. The container of claim 1 or 2 further including a box top component comprising a rectangular sheet having integral extentions at each end edge, said extentions each being provided with a fold line between said extention and said sheet, the width of said sheet being equal to the width of said rectangular bottom wall of said box tray component and the length being equal to the length of said rectangular bottom wall between said tubular ends, the width of said extentions being equal to the height of said inner panels of said bottom wall extentions, the length being equal to the width of said bottom wall less twice the thickness of said tubular ends, said extentions being foldable to a right angle to said sheet whereby said top is supported upon said box tray component along its peripheral length by said tubular sides and along its peripheral width by said bottom wall of said box tray component.

* * * * *